United States Patent [19]

Nelson et al.

[11] Patent Number: 4,845,815

[45] Date of Patent: Jul. 11, 1989

[54] BOBBIN STRIPPING MACHINE

[75] Inventors: Tom W. Nelson, Lenexa; James P. Workman, Springhill, both of Kans.; Daniel K. Taylor, Lone Jack, Mo.

[73] Assignee: Martin Medical, Inc., DeSoto, Kans.

[21] Appl. No.: 121,159

[22] Filed: Nov. 16, 1987

[51] Int. Cl.[4] ..... B65H 73/00

[52] U.S. Cl. ..... 28/295

[58] Field of Search ..... 28/295

[56] References Cited

U.S. PATENT DOCUMENTS

| | | | |
|---|---|---|---|
| 1,289,938 | 12/1918 | Scarples et al. | 28/295 |
| 2,613,425 | 10/1952 | Whitaker . | |
| 2,641,821 | 6/1953 | Sjostrom . | |
| 3,092,889 | 6/1963 | Hayes, Sr. . | |
| 3,112,550 | 12/1963 | Bentley . | |
| 3,137,913 | 6/1964 | Hayes, Sr. . | |
| 3,928,899 | 12/1975 | Maiworm . | |
| 4,078,282 | 3/1978 | van Daalen . | |
| 4,506,575 | 3/1985 | McCay et al. . | |

FOREIGN PATENT DOCUMENTS

| | | | |
|---|---|---|---|
| 1227533 | 4/1971 | United Kingdom | 28/295 |

*Primary Examiner*—Robert R. Mackey

*Attorney, Agent, or Firm*—Hovey, Williams, Timmons & Collins

[57] ABSTRACT

A high speed device (10) for safely removing residual yarn (18) from a paper tube (16) without damage to the latter is provided which includes a specialized multiple-blade cutting assembly (20) serving to completely strip yarn from the tube (16) without tangling. The overall device (10) includes a mandrel assembly (14) for supporting a tube (16) to be processed, together with a shiftable carriage (94) supporting the cutting assembly (20) for axial movement of the latter along the length of the tube (16). The cutting assembly (20) has a high speed, metallic leading cutting blade (68) together with a relatively low speed, synthetic resin trailing cutting blade (70) presenting a serrated outer periphery. The leading blade (68) is oriented slightly above the outer surface of the tube (16) for cutting the majority of the residual yarn (18), whereas the trailing blade (70) is positioned for contacting the tube (16) and removing any yarn remnants (18*a*). A third anti-tangling blade (74) of relatively small diameter is also provided adjacent the blades (68, 70) for removing any yarn picked up by the cutting blade (70).

16 Claims, 3 Drawing Sheets

BOBBIN STRIPPING MACHINE

BACKGROUND OF THE INVENTION

1. Field of the Invention The present invention is broadly concerned with an automated device for the salvaging of paper tubes or cores having residual yarn thereon, in order to permit reuse of the tubes and/or salvage of the yarn. More particularly, it is concerned with such a salvage device which makes use of a specially configured, axially shiftable yarn cutting assembly preferably including leading and trailing yarn cutting blades for cooperatively removing all yarn from the tube, together with a smaller diameter anti-tangling blade serving to remove yarn pieces taken up by the cutting blades. The leading cutting blade is advantageously formed of metal, whereas the trailing blade is preferably formed of synthetic resin material and presents a notched or serrated peripheral cutting edge.

2. Description of the Prior Art

In the manufacture of synthetic yarn and in other textile operations, considerable amounts of yarn are wound onto elongated tubes (sometimes referred to as bobbins) to facilitate yarn storage and use during manufacturing processes. In modern day plants this yarn may be natural or of the synthetic resin variety, e.g. nylon. Typically, all of the yarn wound onto a supporting tube may not be used in a manufacturing process or the yarn breaks, leaving a residuum of the yarn wound on the tube. Thus, in order to reuse the tube, it is necessary to remove the yarn residuum. Reuse of these tubes, and in some cases the yarn is very attractive from an economic point of view, considering the large number of tubes employed and the cost thereof.

Attempts have been made to manually remove residual yarn from tubes through the use of sharp knives or the like. This method is of course extremely slow and labor intensive. Furthermore, it is very probable that a knife utilized for severing the yarn will nick or cut the surface of the tube (which is typically formed of paper). This effectively ruins the tube, inasmuch as such a nick or cut will cause the tube to damage or cut any yarn thereon at a later time.

A number of other attempts have been made to develop stripping or cutting devices for yarn removal, see e.g., U.S. Pat. Nos. 3,928,899, 3,092,889, 2,641,821, 2,613,425, 3,112,550, 3,137,913, 4,078,282, and 4,506,575. These prior devices have been characterized by rather extreme compxlexity, and therefore have not truly served the needs of the industry. Furthermore, such devices are believed to be still plagued by the problem of nicking or cutting the tubes.

Accordingly, there is a real and unsatisfied need in the art for a simplified, relatively high speed machine for removing residual yarn from tubes or bobbins without causing such damage to the underlying tube surfaces which would prohibit reuse thereof.

SUMMARY OF THE INVENTION

The present invention overcomes the problems noted above and provides a greatly improved device for salvaging yarn tubes or bobbins having residual fiber yarn wound thereon which includes a novel, double bladed yarn-cutting assembly which also preferably has a relatively small diameter anti-tangling blade adjacent the yarn cutting blades for preventing wind-up of yarn fragments onto the blades.

Broadly speaking, the preferred salvaging device of the invention includes means for supporting a tube or bobbin having a residuum of yarn thereon, together with a multiple-blade yarn cutting assembly, means mounting the cutting assembly adjacent a supported tube in yarn-cutting disposition, and means for causing relative yarn-cutting movement between the cutting assembly and supported tube.

In one aspect of the invention, the yarn-cutting assembly includes a powered, rotatable, high-speed leading blade and a powered, rotatable, low-speed trailing blade having a serrated outer periphery. The leading blade is preferably formed of metal, whereas the trailing blade is advantageously (although not necessarily) formed of synthetic resin material such as nylon and presents flattened, outermost tube-engaging surfaces between the notches. The leading and trailing blades are mounted with the leading blade positioned in slightly radially spaced relationship to the outer surface of the supported tube and in cutting disposition to the majority of the yarn residuum. On the other hand, the trailing blade is positioned in actual spring and gravity-biased contact with the tube outer surface, and serves to remove any remaining yarn remnants from the tube.

In another aspect of the invention, the yarn cutting assembly has a powered, rotatable yarn cutting blade and an adjacent, powered, rotatable anti-tangling blade, the latter having an effective diameter substantially smaller than that of the yarn-cutting blade. The anti-tangling blade serves to strip or remove yarn fragments from the yarn-cutting blade(s) during operation of the device, so as to prevent unintended wind-up of yarn onto these blades and their drive shafts.

In preferred forms of the invention, the blades making up the cutting assembly are mounted for rotation about substantially parallel axes. Further, the cutting assembly is mounted for axial movement along the length of a supported tube, so that the assembly traverses the effective length of the tube and removes all yarn therefrom.

DESCRIPTION OF THE PREFERRED EMBODIMENT

Figure 1:
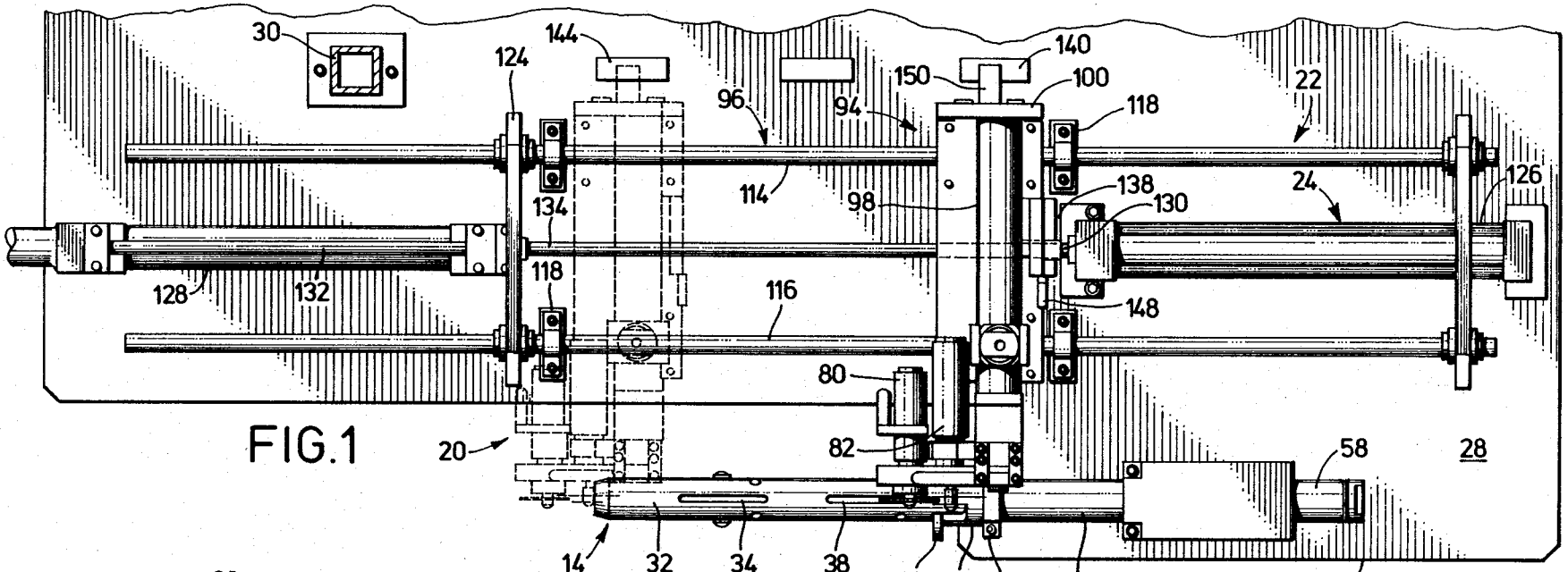
FIG. 1 is a plan view illustrating the tube salvaging device in accordance with the invention, with the shiftable cutting assembly being shown in phantom and in bold lines at the respective limits of travel of the cutting assembly.

Turning now to the drawings, the tube salvage device 10 in accordance with the invention broadly includes a flag base 12, a mandrel assembly 14 for supporting a tube 16 (see FIGS. 5 and 6) carrying a residuum of yarn 18 thereon, a yarn-cutting assembly broadly referred to by the numeral 20, mounting structure 22 for the cutting assemble 20, motive means 24 for selectively moving the cutting assembly, and a control system 26.

Figure 2:
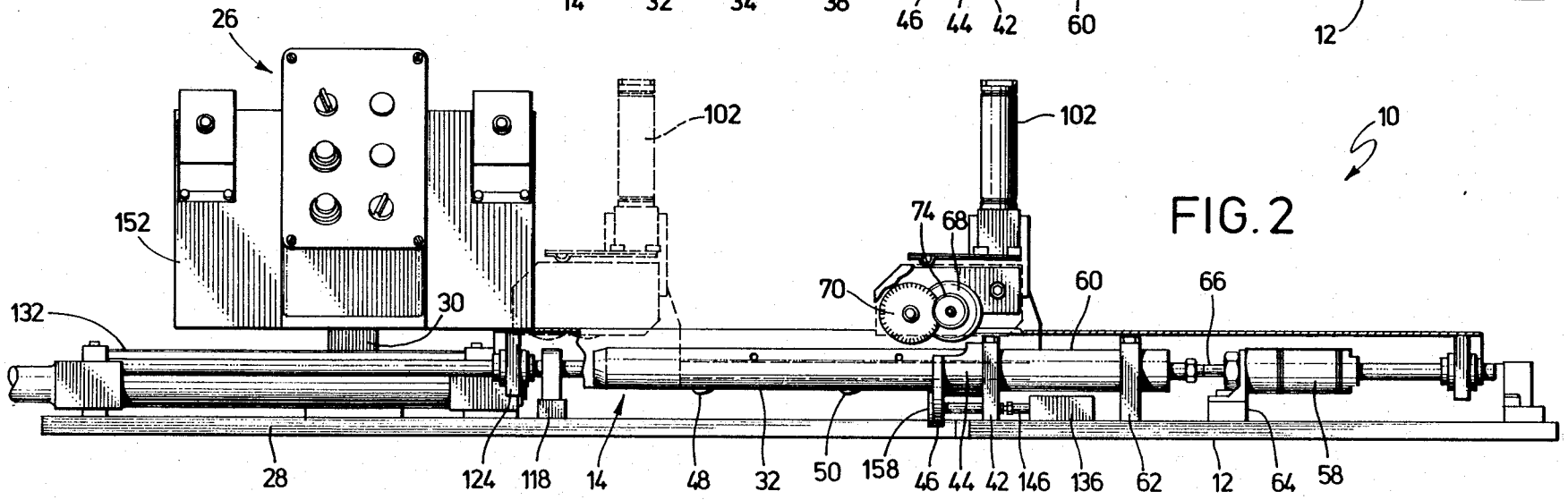
FIG. 2 is a side elevational view of the device depicted in FIG. 1.

In more detail, the base 12 is preferably in the form of a metallic plate 28 serving as a rigid base for the entire mechanism, the plate 28 being somewhat L-shaped in plan as shown in FIG. 1. A standard 30 is secured to and extends upwardly from plate 28 adjacent the rear edge thereof for supporting a control console later to be described. As is apparent from a study of FIGS. 1 and 2, the plate 28 serves as a support for virtually the entirety of the remaining components making up device 10.

The mandrel assembly 14 includes an elongated, tubular mandrel element 32 having a tapered free end and two pairs of mated, axially extending and spaced apart slots, namely opposed slot pair 34, 36 and opposed slot pair 38, 40. The end of mandrel element 32 remote from the open end thereof is supported in a cantilever fashion by attachment to upright plate 42, the latter being affixed to base plate 28. In addition, a forwardly extending collar 44 is affixed to plate 42 and extends a short distance along the length of mandrel element 32. A depending abutment member 46 is secured to the left-hand end of collar 44 as viewed FIG. 6.

The overall mandrel assembly 14 further includes structure for selectively engaging, supporting and stabilizing a tube 16 during operation of device 10. For this purpose, a pair of somewhat triangular tube-engaging plates 48, 50 are respectively situated at least partially within mandrel element 32 and in alignment with the opposed slot pairs 34, 36 and 38, 40. The plates 48, 50 are each mounted for pivotal movement thereof about horizontal pivot pins 52, 54, such that the plates can be moved into and out of the confines of mandrel element 32. In particular, the plates 48, 50 are movable through the agency of an elongated, articulated connecting rod 56 pivotally secured to each of the plates 48, 50 and couple with a pneumatic piston and cylinder assembly 58 best seen in FIGS. 2 and 6. It will be observed in this respect that a tubular body 60 extends rightwardly from plate 42 and is additionally supported by a similar upright plate 62. The assembly 58 is in turn supported by a bracket 64. Hence, the rod 56 extends rightwardly from the plates 48, 50 through mandrel element 32, plate 42, body 60, and plate 62 for connection with the piston rod 66 of assembly 58. It will be appreciated that fore and aft movement of rod 66 illustrated in phantom in FIG. 6 correspondingly causes pivoting movement of the plates 48, 50 between a lowered, tube-engaging position depicted in bold lines in FIG. 6, to a retracted position depicted in phantom.

Yarn-cutting assembly 20 includes a total of three circular blades, namely leading metallic cutting blade 68, serrated synthetic resin trailing blade 70, and small diameter anti-tangling blade 72. As best seen FIGS. 5 and 6, the blades 68, 72 are mounted for coaxial rotation on shaft 74, whereas trailing blade 70 is rotationally mounted on shaft 76 at a location such that the lower periphery of blade 70 is slightly below that of blade 68. Further, it will be seen that the blade 70 is located between the blades 68, 72.

A pivotal mounting block 78 is provided for supporting the shaft 76. This block also serves to support a rearwardly extending air motor coupled with the shaft 76 for rotation thereof in a counter-clockwise direction (FIG. 6); specifically, a 900 rpm air motor 80 is secured to block 78 and is coupled with shaft 76 for rotation of blade 70, and a 25,000 rpm air motor 82 is supported by a secondary block 84 and clamp 86 and is coupled with the shaft 74 for high speed rotation of the blades 68, 72.

The overall mounting for the blade assembly 20 further includes the secondary block 84 extending above plate 78, together with a clamp 86 situated generally above and holding motor 82.

Plate 78 is pivotally supported by provision of a shoulder screw 88 extending through the plate 78 and into secondary block 84. An anti-tangling collar 90 is conventionally secured to air motor 80 by a set screw or other means so that it is stationary and shaft 76 rotates therein. Collar 90 extends closely adjacent to blade 70 to avoid the entanglement of yarns on shaft 76. Blade 68 extends into an annular groove in collar 90. The plate 78 and blades secured thereto are adjustably biased downwardly under the influence of gravity and by provision of an adjustable leaf spring 92 secured to block 84 and engaging the upper surface of the plate 78.

Figure 3:
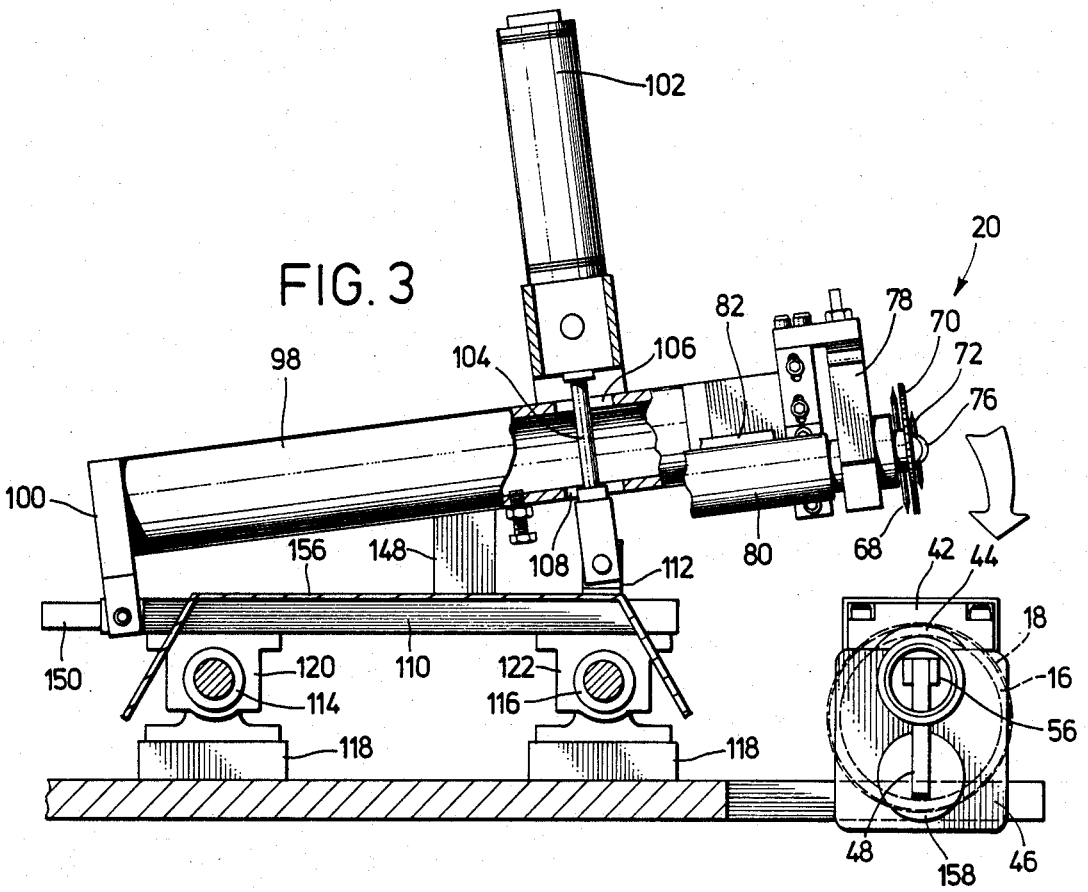
FIG. 3 is an end view partially in section and with parts broken away for clarity illustrating the cutting assemble being moved into cutting disposition relative to a supported tube.
Figure 4:
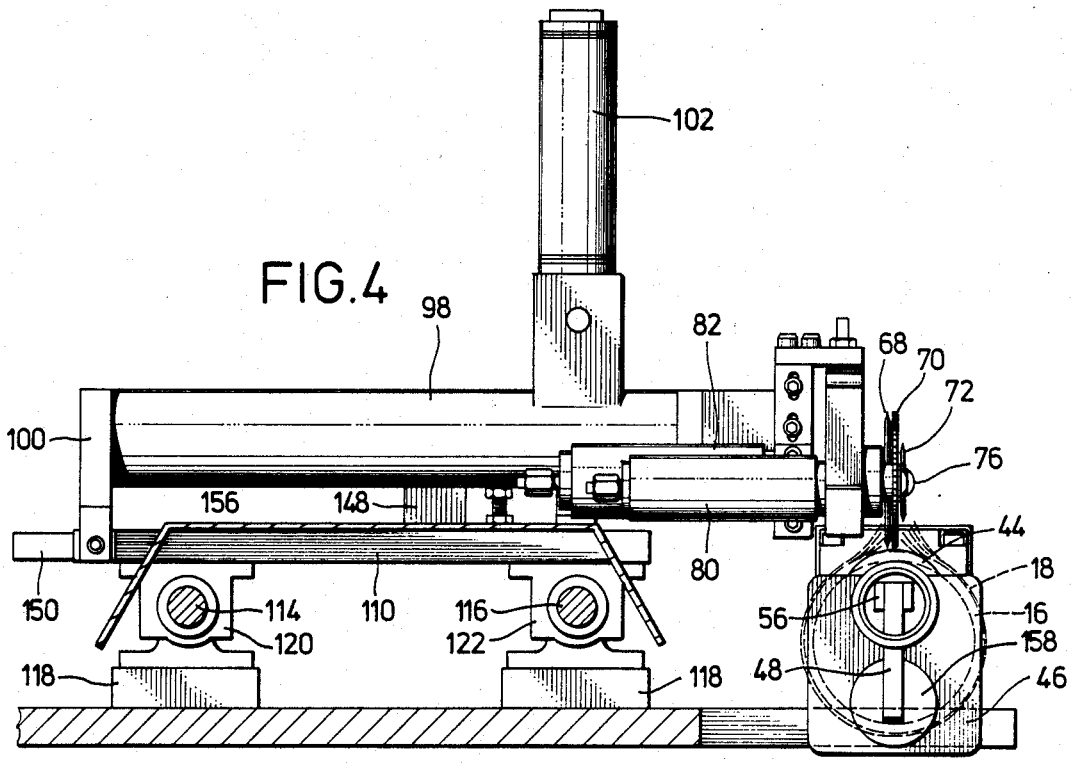
FIG. 4 is a view similar to that of FIG. 3, but showing the device during actual cutting operations.

The mounting assembly 22 broadly includes an elongated carriage member 94 together with a track system 96 for the carriage. Specifically, the carriage member 94 is in the form of an elongated, fore and aft extending tubular body 98 having a rearmost, depending mounting plate 100. The forward end of the body 98 is secured to and supports the secondary block 84 as best seen in FIGS. 3 and 4. In addition, the body 98 has an upright pneumatic piston and cylinder assembly 102 secured thereto rearwardly of secondary block 84 with the assembly 102 including a downwardly projecting piston rod 104 which extends through aligned apertures 106, 108 provided in body 98 beneath the assembly 102 (see FIG. 3).

The carriage member 94 is supported for pivotal movement thereof about a horizontal axis by means of a track-mounted support 110. Specifically, it will be seen that rearmost plate 100 is pivotally secured to support 110 adjacent the rearward end of the latter so as to permit up- and-down pivoting movement of carriage member 94 and hence cutting assemby 20. Such up-and-down movement is effected by the pivotal connection between the lowermost end of piston rod 104 and support 110, as at 112. As will be appreciated from a comparative study of FIGS. 3 and 4, operation of piston and cylinder assembly 102 to exend and retract rod 104 causes the carriage member 94 to be correspondingly pivoted about the rearmost pivotal connection between plate 100 and support 110.

Track system 96 includes a pair of elongated metallic cylindrical rods 114, 116 respectively secured in parallel spaced apart relationship to base plate 28 by means of appropriate footings 118. Again referring to FIGS. 3 and 4, it will be seen that appropriate bearing blocks 120, 122 are affixed to the underside of support 110, and slidably receive the corresponding rods 114, 116. Provision of the track system 96 thus permits shifting movement of the entire carriage member 94 and cutting assembly 20 along the length of the rods 114, 116. In this connection, an elongated adjustable stop plate 124 is secured to and extends transversely between the rods 114, 116 (see FIG. 1), and the function of this plate will be described hereinafter.

Selective lateral movement of the carriage member 94 and cutting assembly 20 supported thereby is achieved by provision of a pneumatic piston and cylinder assembly 126 situated between the rods 114, 116 adjacent the righthand end of plate 28 (FIG. 1), together with an opposed hydraulic checking cylinder assembly 128 similarly located between the rods 114, 116 proximal to the lefthand end of plate 28. In particular, the assembly 126 includes an outwardly extending piston rod 130 which is affixed to the underside of support 110 by a conventional connector (not shown). Thus, extension of rod 130 by actuation of the assembly 126 serves to move the carriage member 94 leftwardly as viewed in FIG. 1. This leftward motion is cushioned and smoothed by virtue of the hydraulic checking cylinder 128, which includes an apertured pipe assembly 132 mounted on hydraulic cylinder 128 and an elongated piston rod 134 extending out of the cylinder 128 and likewise connected to the underside of support 110. Righthand movement of the carriage member 94 is of coures accomplished by retraction of piston rod 130.

The control system 26 for device 10 includes a set of limit switches 136, 138, 140, 142 and 144. Switch 136 is secured to plate 28 beneath tubular body 60 and includes an elongated, outwardly extending connecting rod 146 which extends through plate 42 and abutment member 46. A contact button 158 is secured to the outer end of rod 146 and is located closely adjacent to the lefthand face of abutment member 46 as viewed in FIG. 6. Limit switch 138 is mounted on tubular body 98 and engages contact plate 148 when body 98 is in the lowered position. Contact arm 150 is mounted on support 110 and extends rearwardly therefrom. Switch 140 is mounted on base 12 and engages contact arm 150 when the cutting assembly 20 is at the end of a yarn cutting cycle in the righthand, stopped position. Switch 142 is mounted on base 12 intermediate switches 140 and 144 at a position to engage contact arm 150 corresponding to the desired travel of cutting assembly 20 for tubes 16 of a first, shorter length. Switch 144 is mounted on base 12 at a position to engage contact arm 150 corresponding to the desired travel of cutting assembly 20 for tubes 16 of a second, longer length, indicated by the dotted lines of FIG. 1. The limit switches 136, 138, 140, 142, and 144 are connected through appropriate, conventional control circuitry to an operation, console 152 supported on standard 30 (see FIG. 2) and having the necessary "start" and "stop" buttons. The console 152 is in turn operatively connected to the pneumatic piston and cylinder assemblies 58, 102 and 126, and to air motors 80, 82, for purposes of controlling these components in the manner to be described. Those skilled in the art will recognize, of course, that such electrical and pneumatic control circuity is entirely conventional and within the skill of the artisan.

Although not shown in detail in the drawings, skilled artisans will appreciate that device 10 is provided with the usual safety guards and housings for assuring trouble-free, safe operation. Thus, a housing 154 substantially envelopes the forward faces of the cutting blades, and additional metallic guards such as guard 156 are positioned over portions of the track system.

As explained previously, the purpose of device 10 is to remove the residuum 18 of yarn from an underlying tube 16, all without damage to the tube and at relatively high operational speeds. In order to explain the operational sequence of device 10, it will be assumed that it is at the end of a yarn-cutting cycle, with the carriage member 94 and cutting assembly 20 carriage thereby being at the righthand end of their travel as viewed in bold lines in FIG. 1, and with the carriage member 94 in its upwardly pivoted position depicted in FIG. 3. At this point, the user manually grasps a tube having a residuum of yarn thereon and passes the same over and along the length of mandrel element 32 until the contact button 158 of limit switch 136 is engaged. This initiates action of the piston and cylinder assembly 58 to retract rod 66 and thereby pivot the triangular plates 48 and 50 downwardly to engage and lock the tube 16 in place on the mandrel element 32. The two "start" buttons on console 152 are then simultaneously pushed, which causes actuation of the piston and cylinder assembly 126 to quickly move the carriage member 94 leftwardly until contact arm 150 engages switch 142 or 144. At this point, the pison and cylinder assembly 102 is operated to lower the carriage member 94 until the multiple blades of cutting assembly 20 are adjacent the yarn residuum, whereupon switch 138 signals to activate the motors 80, 82 to operate to rotate the associated blades in a counterclockwise fashion to initiate the cutting action.

The assembly 126 is then reactivated to slowly move the carriage and rotating blades to the right in a yarn-cutting sequence until the rightmost limit switch 140 is actuated, the righthand limit of movement is reached and the yarn is cut from tube 16. When this righthand limit is reached, the carriage member 94 is pivoted upwardly away from the tube 16, the motors 80, 82 cease operation, and assembly 58 is actuated in order to retract the plates 48, 50 into mandrel element 32, thereby releasing tube 16. The tube can thereupon be manually pulled off of mandrel element 32, and the device 10 is then in position to receive another tube for processing.

Figures 5, 6:
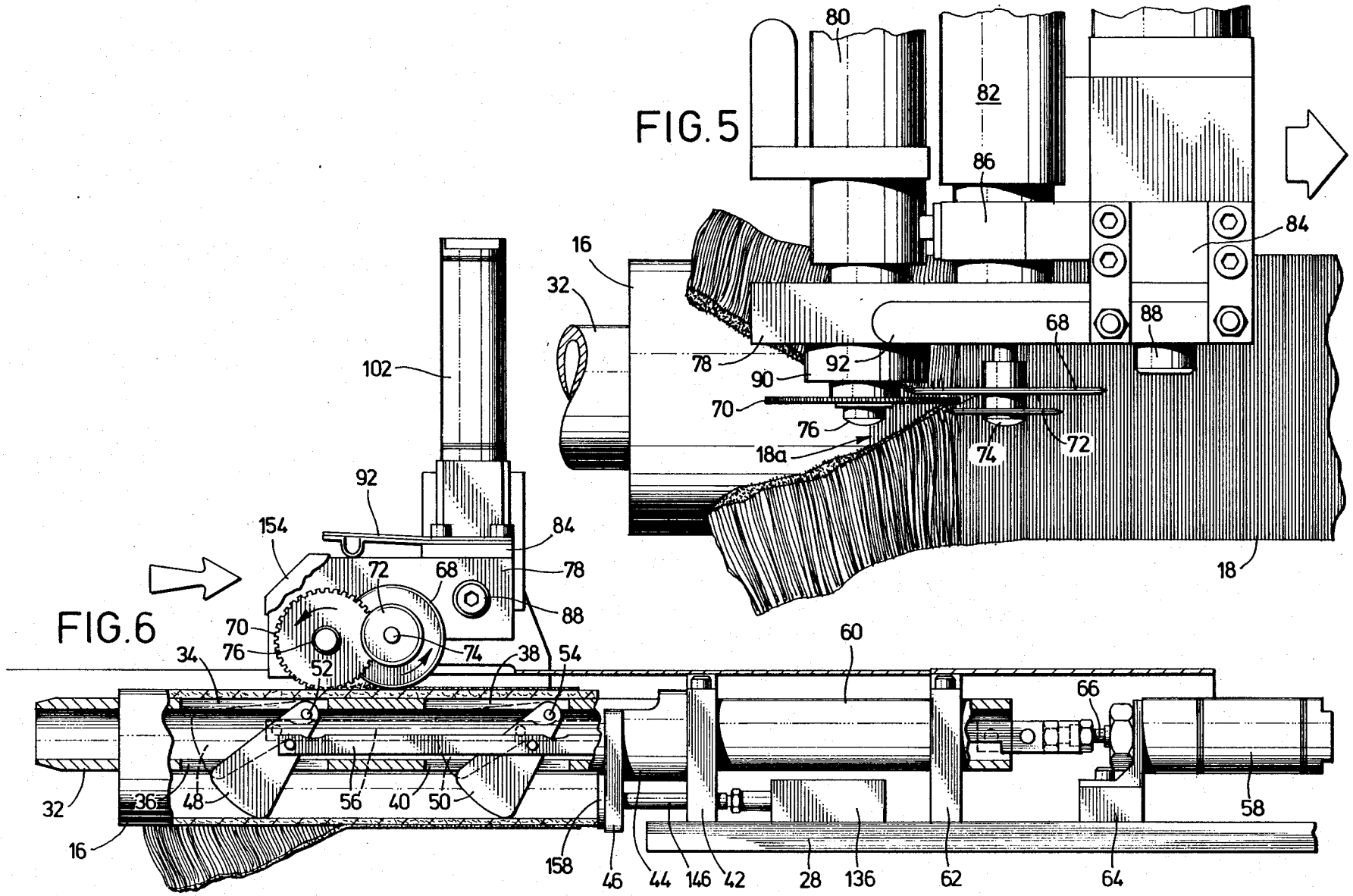
FIG. 5 is a fragmentary, enlarged plan view depicting in detail the cutting head as it traverses a tube and removes a yarn residuum therefrom.
FIG. 6 is a side view in partial vertical section and with parts broken away for clarity depicting the construction and operation of the tube-supporting mandrel and the cutting assembly during yarn cutting operations.

The cutting action of the blades 68, 70, 72 is best understood from a study of FIG. 5. As explained above, the cutting assembly 20 is arranged such that the outer cutting edge of leading blade 68 is slightly above the outer surface of tube 16, but is close enough to cut through a substantial portion of the yarn residuum. Typically though, a small number of yarn fibers, shown as at **18*a* in FIG. 5, remain on the tube 16 after passage of leading blade 68. This remaining yarn 18*a* is effectively removed by the cutting action of the trailing serrated blade 70, which is in engagement with the outer surface of the tube. However, inasmuch as blade 70 presents a series of outermost flattened surfaces, as opposed to a knife edge, it does no damage to tube 16**.

During the cutting operation, anti-tangling blade 72 comes into play to cut yarn caught in the teeth of blade 70 and to prevent wind-up of stray yarn onto the blades 68 or 70 and drive shafts 74 and 76, respectively. It has been found that use of a blade 72 having a substantially smaller diameter than either of the main cutting blades is sufficient to assure freedom from tangles. At the same time, this blade is sufficiently spaced from the tube to prevent any contact therewith. Collar 90 prevents stray yarn from accumulating on shaft 76 while blade 68 removes substantially all yarn deposited on collar 90.

We claim:

1. A device for salvaging tubes and the residuum of yarn wound thereon, said device comprising:

means for supporting a tube having a residuum of yarn wound thereon;

a yarn cutting assembly including a powered, rotatable leading blade having an unserrated knife-edge outer periphery, and a powered, rotatable trailing blade having a serrated outer periphery;

means mounting said cutting assembly adjacent said supported tube with said leading blade positioned in slightly spaced relationship to the outer surface of said tube in cutting disposition to a portion of said yarn residuum, and with said trailing blade positioned in contact with said tube outer surface for final removal of yarn remnants from the tube; and means for causing relative yarn-cutting movement between said cutting assembly and supported tube such that during said yarn-cutting movement said leading blade first encounters said yarn residuum and said trailing blade follows said leading blade.

2. The device of claim 1, said serrated trailing blade being formed of synthetic resin material and presenting flattened outermost tube-engaging surfaces.

3. The device of claim 1, said cutting assembly further including a rotatable anti-tangling blade positioned adjacent said leading and trailing blades for removing yarn picked up by either of the leading and trailing blades, said anti-tangling blade being spaced sufficiently from the tube to prevent any contact therewith and in spaced relationship to said yarn residuum.

4. The device of claim 3, said anti-tangling blade being of substantially smaller diameter than either of said leading and trailing blades.

5. The device of claim 1, said leading and trailing blades being rotatable about substantially parallel axes.

6. The device of claim 1, said movement-causing means comprising structure for moving said cutting assembly axially along the length of said tube in a direction where said leading blade precedes said trailing blade.

7. The device of claim 1, including means for biasing said blades toward said tube.

8. The device of claim 1, said tube-supporting means including a slotted, elongated mandrel, a pivotal tube-stabilizing element positioned at least partially within said mandrel, and means for selectively pivoting said element to move the same outwardly of the mandrel and into stabilizing contact with the interior surface of a tube to be stabilized.

9. A device for salvaging tubes having a residuum of yarn wound thereon, said device comprising:

means for supporting a tube having a residuum of yarn wound thereon;

a yarn cutting assembly including a powered rotatable leading blade having an unserrated knife-edge outer periphery, rotatable trailing blade having a serrated periphery, and a powered, rotatable anti-tangling blade adjacent said leading and trailing blades, each of said blades being rotatable about substantially mutually parallel axes, said anti-tangling blade having a diameter substantially less than the diameters of said leading and trailing blades;

means mounting said cutting assembly adjacent said supported tube with said leading blade positioned slightly outwardly of the outer surface of said tube in cutting disposition to the majority of said yarn residuum, with said trailing blade positioned in actual contact with said tube outer surface for final removal of yarn remnants from the tube, and with said anti-tangling blade located in spaced relationship to said yarn residuum; and means for moving said cutting assembly axially along the length of said supported tube in a direction where said leading blade precedes said trailing blade.

10. The device of claim 9, said anti-tangling blade being located in side-by-side juxtaposition to said leading and trailing blades.

11. The device of claim 9, said mounting means including means for automated pivotal movement of said cutting assembly between a first position wherein said leading, trailing and anti-tangling blades are adjacent said yarn residuum, and a second position wherein said leading, trailing and anti-tangling blades are spaced away from said tube.

12. The device of claim 11, said device including means for automatically initiating pivoting of said cutting assembly between said first position and said second position at a preselected location along the axial length of said supporting means.

13. The device of claim 12, said device including means for automatically initiating rotation of said blades when said cutting assembly is in said first position and means for ceasing rotation of said blades when said cutting assembly is in said second position.

14. The device of claim 13, including means for selectively pivoting said cutting assembly from said first position to said second position according to the length of said tube.

15. The device of claim 9, said leading blade and said anti-tangling blade being rotatable about a first, mutual axis, and including a collar horiziontally spaced from said serrated blade, the collar and serrated blade being mounted on a second axis.

16. The device of claim 15, said trailing blade being oriented such that a portion of its serrated periphery is intermediate said leading blade and said anti-tangling blade and said leading blade having a periphery, a portion of the periphery of said leading blade being oriented between said serrated blade and said collar.

* * * * *